United States Patent [19]

Wilhelmsen

[11] 3,997,939

[45] Dec. 21, 1976

[54] TRUCK BODY HINGE

[76] Inventor: Irven R. Wilhelmsen, 6359 Dominica St., Cypress, Calif. 90630

[22] Filed: Sept. 29, 1975

[21] Appl. No.: 617,423

[52] U.S. Cl. ..... 16/171; 16/128 R

[51] Int. Cl.[2] ..... E05D 1/06

[58] Field of Search ..... 16/128 R, 171, 150, 16/186, 189, 168, 135, 152, 153, 143, 157; 49/381–386, 388, 396

[56] References Cited

UNITED STATES PATENTS

| | | | |
|---|---|---|---|
| 1,734,810 | 11/1929 | Jeffers | 16/171 X |
| 2,990,571 | 7/1961 | Buchholtz | 16/171 |
| 3,191,219 | 6/1965 | Valgi | 16/171 |
| 3,242,523 | 3/1966 | Daley | 16/171 |
| 3,348,259 | 10/1967 | Whilhelmsen et al. | 16/128 R |
| 3,663,987 | 5/1972 | Hawkins | 16/128 R |
| 3,911,528 | 10/1975 | Rojic | 16/128 R |

*Primary Examiner*—G. V. Larkin
*Attorney, Agent, or Firm*—Dan E. Keech

[57] ABSTRACT

A structure comprising two interlocking hollow semi-cylindrical elements, one of which is larger than and encloses the other, and formed respectively by stamping operations from the material of contiguous edge portions of two sheet metal plates, which structure prevents broadside separation of said plates while allowing free relative articulation through an angle of 180°, and producing a tight joint between said plates at each extremity of said articulation and being free of sharp edges when said hinge is either in closed or open position.

3 Claims, 6 Drawing Figures

TRUCK BODY HINGE

BACKGROUND OF THE INVENTION

The present invention is an outgrowth of and an improvement upon the hinge illustrated in U.S. Letters Patent No. 3,348,258 which issued Oct. 24, 1967 and in which the present applicant is one of the joint patentees.

SUMMARY OF THE INVENTION

The hinge comprised in the aforesaid U.S. patent is formed entirely on a brake by producing in adjoining edges of two sheet metal plates two or more right angle bends and then inwardly therefrom a bend of less than a right angle.

It is a primary object of the present invention to produce a hinge primarily adapted for use on a truck body and having the merits of the hinge covered by the aforesaid patent but having the additional merit of occupying less space and being so formed as to present a smooth streamlined appearance in all positions of the hinge.

Another object of the invention is to provide such a hinge on a cover that may optionally be locked against unauthorized separation by side plates welded thereon or by a screw lock the head of which is enclosed by said cover when said cover is shut.

DETAILED DESCRIPTION OF THE PREFERRED EMBODIMENT

Figure 1:
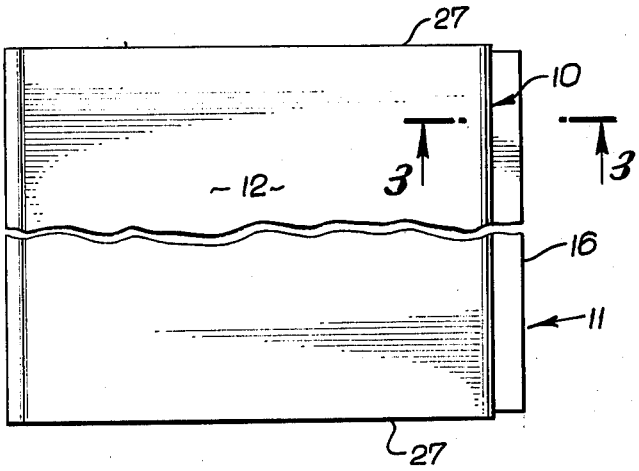
FIG. 1 is a diagrammatic plan view of a cover provided on a truck body and incorporating a preferred embodiment of the aforesaid invention and with said cover in closed position.
Figure 5:
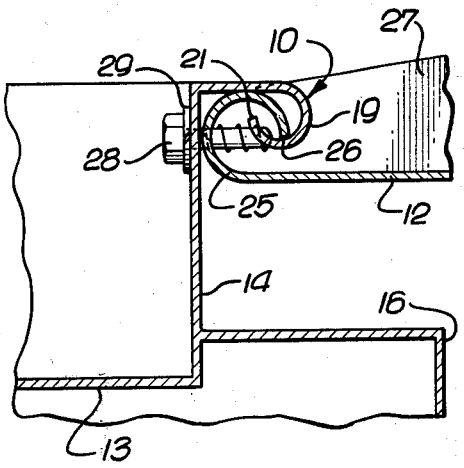
FIG. 5 is a view similar to FIG. 3 but taken with said cover in open position.
Figure 3:
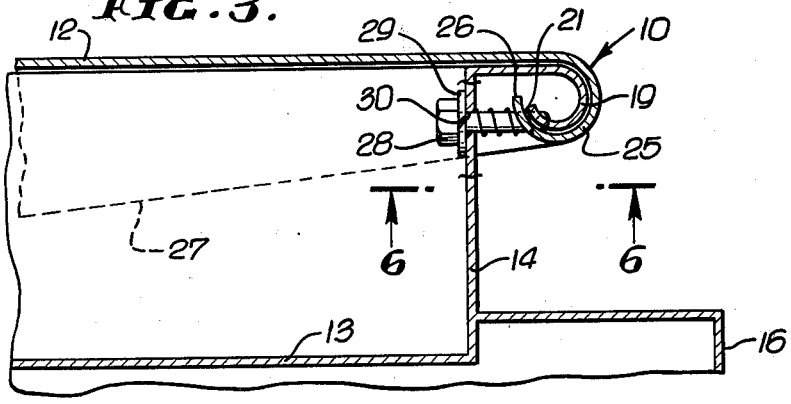
FIG. 3 is an enlarged fragmentary sectional view illustrating the hinge of the invention and taken on line 3—3 of FIG. 1.

The preferred embodiment 10 of the hinge of the invention is shown in the drawings as embodied with a tool cabinet 11 comprising part of a pick-up truck body (not shown) and pivotally mounting a cover 12 for a tray 13 provided in the top portion of said cabinet. The tray 13 has an inner side wall 14 and an outer side wall 15 which are recessed inwardly from side walls 16 and 17 of the cabinet so as to protect inner and outer sides of the cover 12 from damage. The hinge 10 of the invention is incorporated with an upper edge portion of the inner tray side wall 14 and the corresponding inner side portion of the cover 12. This shaping of the inner tray side wall 14 bends a substantial portion of this side wall outwardly at a right angle to form inner hinge element 19 which is characterized by having the outer edge portion thereof bent downwardly to produce approximately ⅝ of a cylindrical tube, the inner edge 21 of which is spaced downwardly from the horizontal portion of the inner hinge element 19 and horizontally from the outer tray side wall 14 as shown in FIGS. 3 and 5. The inner edge portion of the cover 12 when the latter is closed overlies and rests upon the horizontal portion of the inner hinge element 19 and has an outer hinge element 25 shaped downwardly therefrom, this element comprising approximately ¾ of a cylindrical tube which is of larger diameter than the inner hinge element tube 19 so as to be telescopically slideable over the latter when assembling the hinge 10. The terminal lip 26 of the outer hinge element tube 25 is spaced from the cover 12 so as to allow rotation of the cover from the position shown in FIG. 3 to the position shown in FIG. 5 without permitting any broadside separation of the cover 12 from the tool cabinet 11 and provides a substantially tight seal between the cover and the cabinet in both of these extreme positions.

Figure 6:
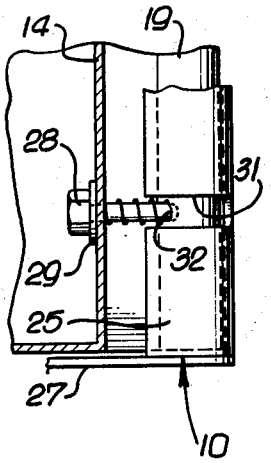
FIG. 6 is a fragmentary detailed sectional view taken on the line 6—6 of FIG. 3 and illustrating the internal screw lock provided in the invention for locking the telescopically assembled elements of the invention against endwise telescopic movement, thus preventing the disassociation of said hinge elements when the cover with which the same are embodied is closed.

Two means are optionally employed for preventing the hinge elements 19 and 25 from being separated telescopically after they are originally assembled. The first of these means comprises end flanges 27 welded to the opposite ends of the cover 12 and to opposite ends of the outer hinge element 25 as shown in FIGS. 3, 5 and 6. The other of these alternatives is the provision of a self-thread-cutting screw 28 which is inserted through a lock washer 29 and a hole 30 provided in inner tray side wall 14, the hole 30 lying in the same vertical plane with a radial slot 31 formed in outer hinge element 25 thereby locking the two hinge elements against telescopic movement relative to each other. The inner hinge element 19 may also be provided with a hole 32 for receiving the tip of the screw 28 so as to rigidly support said screw against displacement.

Figure 2:
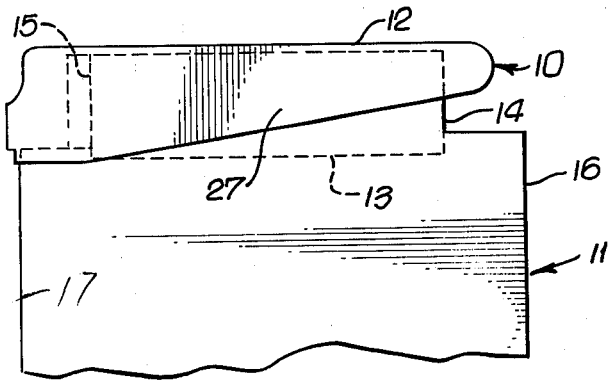
FIG. 2 is a side elevational view of FIG. 1.
Figure 4:
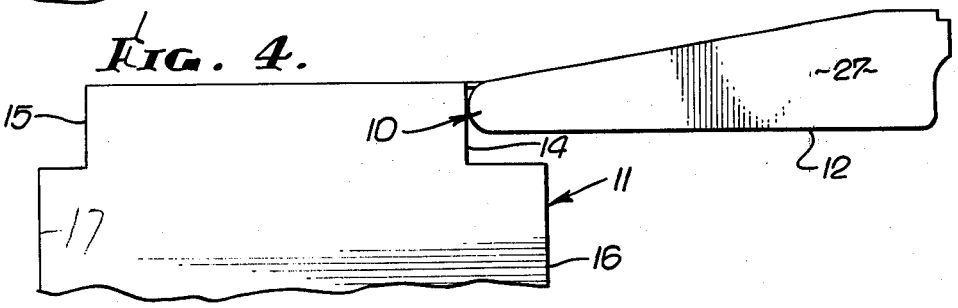
FIG. 4 is a view similar to FIG. 2 and showing said cover in open position.

While the lock screw 28 has been described as an alternate principal locking feature of the invention it may also be employed as a supplementary lock while principal dependence is placed upon the difficulty of shifting the cover 12 lengthwise relative to the cabinet 11 when the cover is latched closed in covering relation with the upper end of the tray 13, as clearly shown in FIG. 2. When the cover is so closed, the cover end flanges 27 overlap the upper extremity of the cabinet 11 so that it is practically necessary to destroy the cover in order to remove it from the cabinet, that is of course, unless means provided for unlocking the free end of the cover is operated to permit this to be swung up and outwardly as shown in FIG. 4 about the pivot provided for the cover by the hinge 10 of the invention.

Attention is also directed to the outstanding advantage of the hinge 10 of the invention in the small space it occupies and in the fact that the inner and outer hinge elements are practically concentrically telescopically related to form a snug bearing when the cover is closed. The hinge 10 also provides a streamlined external appearance which is preferable over the many angles presented by the closest reference of the prior art and referred to hereinabove.

I claim:

1. In combination:

a sheet metal structural element supported vertically, an upper portion of said element being bent horizontally therefrom, the free edge of said upper portion being shaped cylindrically downwardly to form approximately ⅝ths of a cylindrical tube therefrom, said tube comprising the inner of two hinge elements;

a second flat sheet metal structural element resting on, when closed, and overlapping said first hinge element, the edge portion of said second structural element being shaped downwardly cylindrically to form therefrom a second hinge element comprising approximately ¾ths of a cylindrical tube, said second hinge element approximately concentrically telescopically enclosing said first hinge element therein, the gap between the terminal lip of said second hinge element and said second sheet metal structural element being such as to prevent broadside separation of said two hinge elements after they have been telescopically fitted together; and means for retaining said hinge elements against relative telescopic shifting which would separate the same.

2. A combination as recited in claim 1 wherein said second hinge element has freedom to freely rotate relative to said first hinge element through an angle of 180°, said hinge element forming substantially a tight seal along the line of said hinge at each of said extreme positions of rotation of said elements relative to each other.

3. A combination as recited in claim 1 wherein said second hinge element is embodied with a cover of a cabinet which when closed conceals a lock screw provided in said first flat sheet metal structural element and extending into a radial slot formed in said second hinge element, thereby preventing telescopic movement between said two hinge elements which might be the occasion for telescopically separating the same by unauthorized persons.

* * * * *